US005425475A

United States Patent [19]

Clark

[11] Patent Number: 5,425,475

[45] Date of Patent: Jun. 20, 1995

[54] EPOXY DISPENSER

[75] Inventor: Bryan J. Clark, Brookfield, Wis.

[73] Assignee: Power Epoxy, New Berlin, Wis.

[21] Appl. No.: 115,514

[22] Filed: Sep. 1, 1993

[51] Int. Cl.[6] ..... B65D 35/28

[52] U.S. Cl. ..... 222/103; 222/105

[58] Field of Search ..... 222/94, 95, 101, 103, 222/105-107, 145, 183, 541, 326; 206/219, 222; 401/155, 158

[56] References Cited

U.S. PATENT DOCUMENTS

| | | | |
|---|---|---|---|
| 2,767,383 | 10/1956 | Patterson, Jr. | 222/103 |
| 2,903,161 | 9/1959 | Stahmer | 222/103 |
| 3,418,059 | 12/1968 | Robe | 222/107 |
| 3,946,094 | 3/1976 | Mulakala | 222/105 |
| 4,036,412 | 7/1977 | Craig | 222/103 |
| 4,341,302 | 7/1982 | Baker et al. | 222/94 |
| 4,797,309 | 1/1989 | Kammerer et al. | 222/541 |
| 4,928,851 | 5/1990 | Fatherly | 222/103 |
| 4,991,989 | 2/1991 | Fitjer | 401/155 |
| 5,209,397 | 5/1993 | Fabisiewicz et al. | 206/219 |

*Primary Examiner*—Andres Kashnikow
*Assistant Examiner*—Philippe Derakshani
*Attorney, Agent, or Firm*—Reinhart, Boerner, Van Deuren, Norris & Rieselbach

[57] ABSTRACT

A method and apparatus for dispensing adhesives having first and second parts including premeasured adhesive portions contained in compartments of a package. A dispenser includes a top portion hingeably coupled to a bottom portion, with the portions defining a cavity dimensioned to receive a package containing adhesives therein. A squeegee slideably engages the dispenser and the package. The dispenser further includes a retaining structure for holding the package in place in the dispenser while the squeegee moves the adhesives through the package to a package nozzle.

3 Claims, 3 Drawing Sheets 10
56
58
12
22
20
24
26
36
40
35
36
28
47
44
42
46

14
16
60
18
30
30
62
66
65
66
58
56
38
34
50
20
52
48

14
62
64
30
16
18
22
24
40
47
28
56
20
52

EPOXY DISPENSER

BACKGROUND OF THE INVENTION

This invention relates generally to dispensers and, more particularly, to a dispenser system for two-part epoxy adhesives and the like.

Epoxy adhesives are highly versatile and are effective in a variety of applications. Such adhesives, as a rule, are supplied in two parts ("resin" and "hardener") that must be mixed together immediately before use. The need to keep the two pans separate until immediately before use complicates the packaging for epoxy adhesives. Similarly, the need to measure and mix the two parts in equal volumes makes the use of epoxy adhesives somewhat more inconvenient than ready-to-use, one-part adhesives. For these reasons, a variety of systems and methods have been proposed for packaging two-pan epoxy adhesives.

In one well-known system, the resin and hardener parts of the epoxy are packaged in separate squeeze tubes. The user is expected to squeeze equal amounts of the resin and hardener onto a suitable mixing surface, gauging the proper ratio more or less by eye. Although capable of producing an effective adhesive, this system has a number of drawbacks. First, because two separate tubes are provided, it is possible for one of the tubes to become misplaced or otherwise lost. In this event, the remaining tube is of little use or value. Furthermore, because the proper ratio must be gauged by eye, a certain degree of skill and care is needed to ensure that the proper proportions of resin and hardener are obtained. Even relatively minor errors in the ratio of resin to hardener can compromise the strength of the final bond. Finally, when the usable portion of the epoxy adhesive has been consumed, there still remains some unmixed and uncured resin and hardener in the respective resin and hardener tubes. These tubes should not be disposed of in a landfill because it is possible for the uncured resin and hardener to flow into the soil, thereby contaminating the environment.

Another well-known packaging system includes a syringe-like container having two parallel, similarly dimensioned chambers and a plunger extending into each chamber. When the plunger is depressed, approximately equal quantities of resin and hardener are dispensed. Although this system is effective in providing a proper ratio of hardener to resin, the system is relatively expensive, and the actual weight of the package itself (typically made of molded polyethylene) sometimes exceeds that of the epoxy adhesive it contains. Furthermore, after use the package continues to contain some uncured resin and hardener, which makes the used package unsuitable for recycling or for disposal in a landfill.

In both these prior systems, it is necessary for the user to provide a suitable mixing surface as well as the implements needed to mix and apply the epoxy adhesive. This creates a messy work area and often necessitates disposal of the used mixing implements. Additionally, the user can inadvertently touch the pool of mixed adhesive, leading to further mess and inconvenience.

SUMMARY OF THE INVENTION

One embodiment of the invention provides a package and a dispenser for adhesives having first and second parts. The package comprises a plastic packet having two compartments. A predetermined quantity of the first part of the adhesive is contained within a first compartment, while a predetermined quantity of the second part of the adhesive is contained in a second compartment. The predetermined quantities of the first and second parts of the adhesive are in a predetermined ratio of the first part to the second part. The package includes holes and a slot for engaging retaining posts and a retaining tab that hold the package in a desired position in the dispenser. The package further includes an angled end having a perforated section for easy opening of the package and precise control of the adhesive application.

The invention also provides a dispenser for two-part epoxy adhesives wherein the dispenser includes an upper and lower portion coupled together and forming a cavity therebetween. The cavity is dimensioned to receive substantially the entire package of epoxy therewithin, and is provided with an outlet for a nozzle portion of the package. The upper portion of the dispenser supports a squeegee that slides along the upper portion of the dispenser moving epoxy toward and through the outlet of the cavity and the nozzle of the package.

It is a general object of the present invention to provide a new and improved dispensing system for two-part epoxy adhesives and the like.

It is a further object of the present invention to provide a novel dispensing system for epoxy adhesives that includes a refillable dispenser using refill packages that are inexpensive to manufacture.

It is a still further object of the present invention to provide an improved dispensing system for epoxy adhesives utilizing single use quantities of packaged adhesive components to minimize production costs, waste and avoid adverse impact on the environment.

It is still another object of the present invention to provide a packaging system for epoxy adhesives that simplifies mixing the proper ratio of hardener to resin.

It is still another object of the present invention to provide an improved package for adhesives that provides easy opening of the package as well as precise application of the package contents.

It is still another object of the present invention to provide a method and apparatus for dispensing adhesives that include a package for adhesives having a nozzle extending past the nozzle portion of the dispenser, thereby preventing bonding of the nozzle portion of the dispenser.

It is still another object of the present invention to provide a method and apparatus for dispensing adhesives that includes structure for hanging the apparatus for convenient storage.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figures 1, 2:
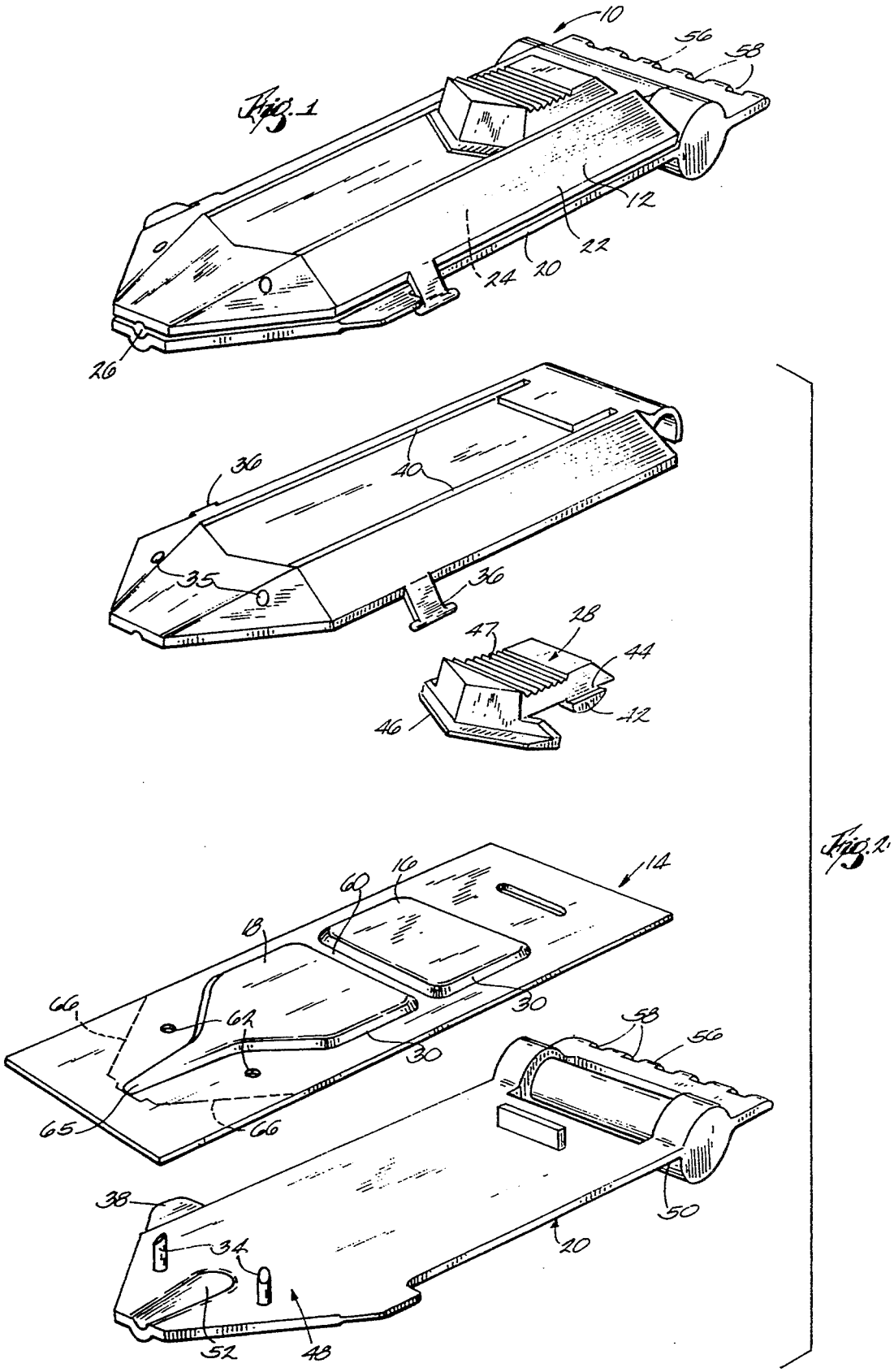
FIG. 1 is a perspective view of a dispensing system constructed in accordance with one aspect of the invention showing the dispensing system in a closed configuration.
FIG. 2 is an exploded perspective view of the dispenser system and package shown in FIG. 1.

Referring to the FIGURES, and more particularly to FIGS. 1 and 2, a dispensing system embodying various features of the invention is indicated generally at 10. The system 10 generally includes an easy-to-use, hand-held dispenser 12 and one or more single use packages 14 containing (in separate compartments 16, 18) both components of an epoxy or other two-part adhesive. The dispenser 12 comprises a lower portion 20 coupled to an upper portion 22 and defining a cavity 24 therebetween. While various conventional coupling means can be used equivalently, preferably a hinge is used.

Figure 9:
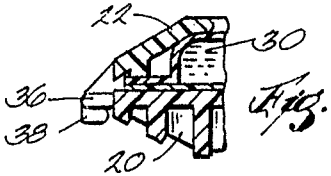
FIG. 9 is a cross-sectional front view of a dispenser system showing upper locking tabs engaging lower locking tabs.

In the illustrated embodiment, the cavity 24 is dimensioned to receive one of the adhesive containing packages 14. The cavity 24 extends to a dispenser nozzle 26 that is also defined by the lower portion 20 and upper portion 22 of the dispenser 12. The upper portion 22 of the dispenser 12 slideably engages a squeegee 28 capable of moving the adhesive 30 toward the dispenser nozzle 26. As the squeegee 28 moves the adhesive 30 in the package 14, the adhesive 30 is pushed toward the dispenser nozzle 26. A retaining tab 32 and retaining posts 34 retain the package 14 in the desired location in the dispenser 12 as the squeegee 28 moves. The dispenser 12 is retained in a closed position by upper locking tabs 36 and lower locking tabs 38 affixed to the upper portion 22 and lower portion 20, respectively, as shown in FIGS. 1, 2 and 9. While a variety of conventional materials can be used, preferably the,dispenser 12 and squeegee 28 comprise high impact polystyrene.

As illustrated in FIG. 2, the upper portion 22 of the dispenser 12 includes a track 40 that engages the squeegee 28. The squeegee 28 includes rear tabs 42 that extend transversely of the squeegee 28 body and engage the bottom of the track 40. The squeegee 28 also includes an upper ridge 44 that engages the track 40 and prevents the squeegee 28 from being pushed down through the upper portion 22 of the dispenser 12.

The front portion of the squeegee 28 includes a V-shaped plow 46 that engages the bottom of the track 40 and is retained in position under and adjacent to the upper portion 22 of the dispenser 12. The engagement of the V-shaped plow 46, the rear tabs 42 and the upper ridge 44 of the squeegee 28 with the track 40 prevent the squeegee 28 from pivoting from its desired position. The V-shaped plow 46 is dimensioned so that it is wider than the compartments 16, 18 of the package 14. When so dimensioned, no adhesive 30 can leak around the side of the V-shaped plow 46 during operation. Furthermore, the V-shaped plow 46 and the rear tabs 42 smoothly engage the package 14, ensuring complete emptying of the package 14 without binding. Finally, the upper portion of the squeegee 28 is shaped to substantially conform to the human thumb and includes ridges 47 to provide a nonslip contact surface.

The lower portion 20 of the dispenser 12 includes a lower nozzle portion 48 and a lower rear portion 50. The lower nozzle portion 48 includes the lower locking tabs 38 that engage the upper locking tabs 36 as shown in FIGS. 1 and 9. Interlocking engagement of the lower locking tabs 38 and the upper locking tabs 36 retains the dispenser 12 in a closed configuration. The dispenser 12 is opened by twisting the upper locking tabs 36 upward and away from the lower locking tabs 38.

Figure 6:
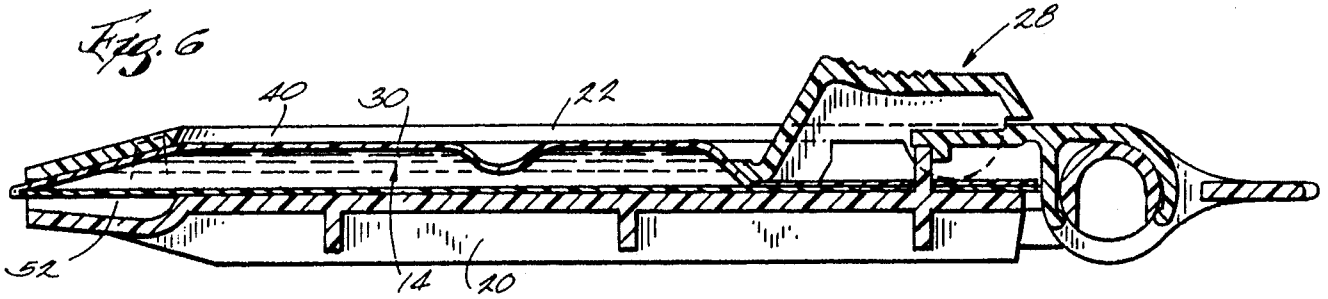
FIG. 6 is a cross-sectional view of the dispensing system shown in FIGS. 1–5 showing the squeegee forcing adhesive toward the nozzle.
Figure 7:
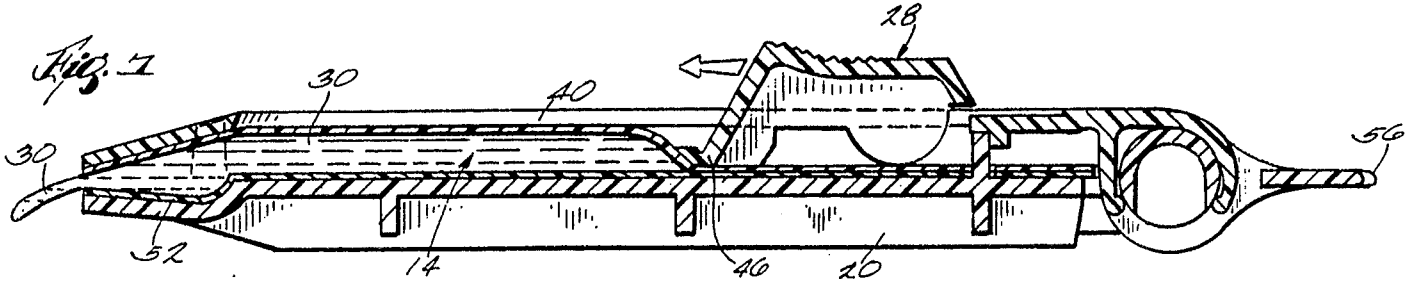
FIG. 7 is another cross-sectional view of the dispensing system shown in FIGS. 1–6 showing the squeegee forcing adhesive toward and through the expanded package nozzle.
Figure 8:
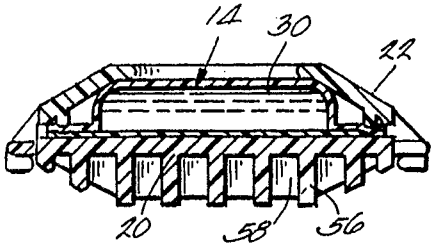
FIG. 8 is a cross-sectional end view of the dispensing system illustrated in FIGS. 1–7.

The lower nozzle portion 48 (and the corresponding component in the upper portion 22 of the dispenser 12) is tapered to generally match the contour of the package 14 after it is opened. This allows a package to be tom away along the dispenser 12 to yield the desired contour. A nozzle relief portion 52 is included in the lower nozzle portion 48 of the dispenser 12. This allows the package 14 to expand slightly in this area as adhesives 30 are being dispensed therefrom as illustrated in FIGS. 6 and 7.

Figure 10:
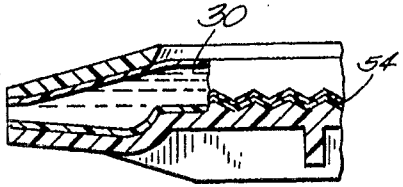
FIG. 10 is a cross-sectional view of an alternative embodiment of a retaining means.

The lower nozzle portion 48 also includes the two retaining posts 34 that engage holes 35 in the upper portion 22 of the dispenser 12 as shown in FIG. 2. Along with a retaining tab 32 contained in the lower rear portion 50 of the lower portion 20 of the dispenser 1.2, the retaining posts 34 retain the package 14 in the desired position throughout the dispensing process. Furthermore, replacement packages 14 can be easily placed on the retaining posts 34 and retaining tab 32 for use. The package 14 may be easily removed from these retaining posts 34 after the contents of the package 14 have been dispensed. Alternatively or additionally, interdigitating gripping teeth 54 integral to the lower portion 20 and upper portion 22 of the dispenser 12 (as shown in FIG. 10) can be used to retain the package 14 in position.

Figures 3, 4, 5:
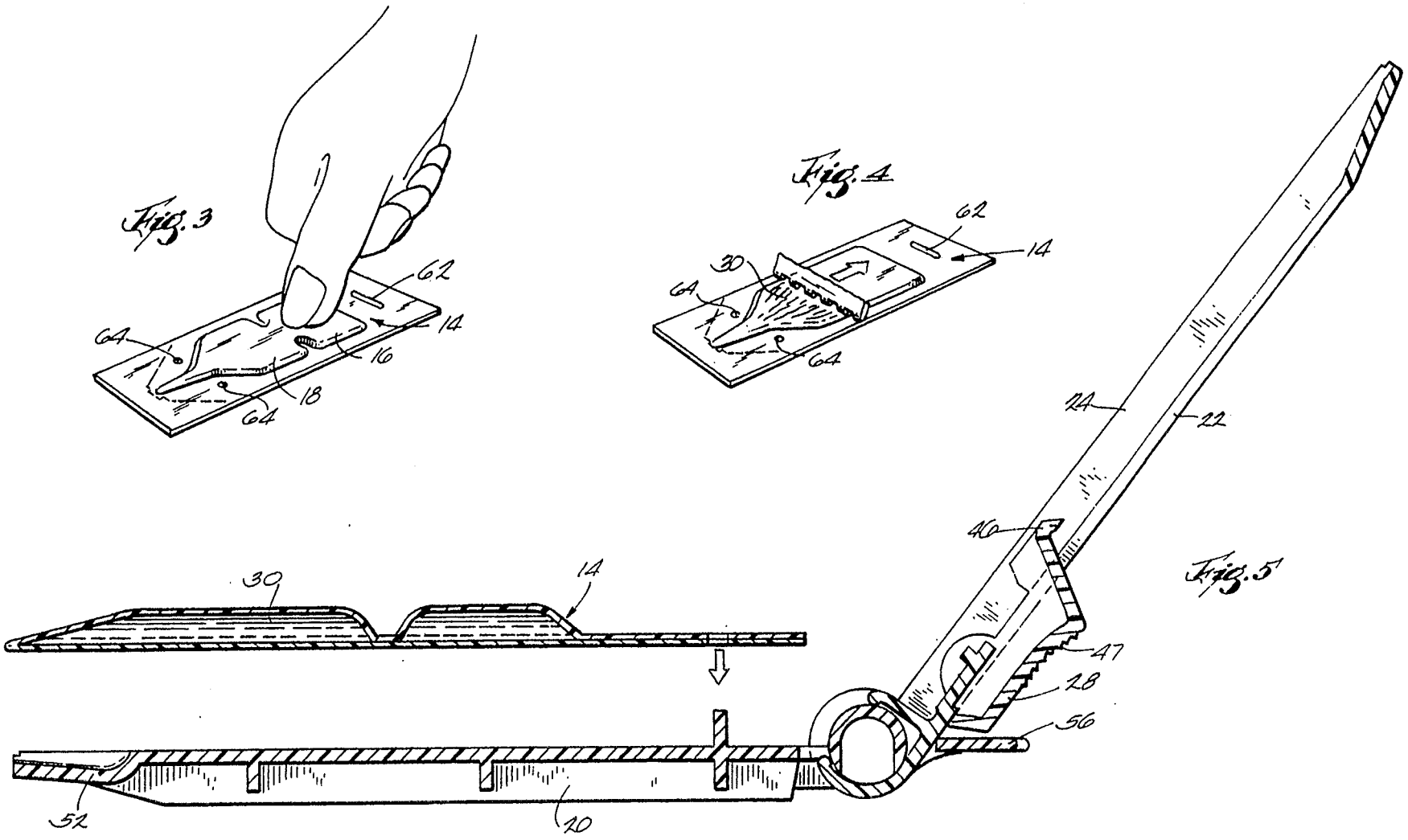
FIG. 3 is a perspective view of a package constructed in accordance with one aspect of the invention.
FIG. 4 is a perspective view of the package shown in FIG. 3.
FIG. 5 is a cross-sectional view of the system shown in FIGS. 1 and 2 showing the dispensing system in an open configuration.

The lower rear portion 50 of the dispenser 12 also includes a mixing tool 56. The mixing tool 56 enables the package 14 contents to be easily and thoroughly mixed for strong resulting adhesive bonds. The mixing tool 56 is moved over the package 14 (as illustrated in FIG. 4), forcing resin and hardener to flow through the slots 58 in the mixing tool 56, thereby providing effective mixing.

The package 14 includes a resin compartment 16 and a hardener compartment 18 separated by a frangible seal 60. Areas surrounding the resin compartment 16 and the hardener compartment 18 are permanently sealed. Although the package 14 and the frangible seal 60 can comprise a wide variety of conventional materials produced by a variety of conventional processes, preferably outer layers of 48 gauge polyethylene terephthalate (PET) are laminated to an inner layer of 2.5 rail sealing material with an adhesive. In one suitable sealing technique, a frangible seal 60 is produced by lower process times C dwell), process temperatures and pressures than the permanent seals surrounding the majority of the resin compartment 16 and the hardener compartment 18. The longer process times, temperatures and pressures produce stronger adhesive bonds between the outer layers of PET and the inner layer of sealing material, thereby producing a nonfrangible seal about the perimeter of the package 14.

The package 14 further includes a retaining slot 62 for engagement with the retaining tab 32 and two retaining holes 64 that engage the retaining posts 34 of the lower portion 20 of the dispenser 12. This engagement retains the package 14 in position in the cavity 24 as the squeegee 28 moves the package 14 contents toward and through a package nozzle 65.

The package nozzle 65 portion includes serrations 66 along predetermined lines. These serrations 66 enable the package 14 to be easily opened to a predetermined contour. This predetermined contour allows a small portion of the package 14 to extend slightly past the upper portion 22 and lower portion 20 of the dispenser 12. This prevents the adhesive 30 from bonding the upper portion 22 and lower portion 20 of the dispenser 12 together. Furthermore, the predetermined contour yields a package nozzle 65 capable of precise application of the package 14 contents.

To use the dispenser 12, the user first breaks the frangible seal 60 of the package 14 as shown in FIG. 3. Next, the user uses the mixing tool 56 on the dispenser 12 to effectively mix the contents of the resin compartment 16 and the hardener compartment 18. While not critical to the invention, the contents of the resin compartment 16 and the hardener compartment 18 can be formulated with a color indicator so that proper mixing can be readily accomplished and ascertained. Furthermore, the relative sizes of the resin and hardener compartments 16, 18 can be varied to accommodate special purpose formulations that are mixed in 3 to 1, 5 to 1 or ratios other than 1 to 1. This makes it easy for nonexpert users to achieve successful results when using epoxy formulations that require precise mixing ratios.

After the package 14 contents are thoroughly mixed, the package 14 is placed in the dispenser 12 so that the retaining tab 32 engages the retaining slot 62 and the retaining posts 34 engage the retaining holes 64. The upper portion 22 of the dispenser 12 is hingeably pivoted into flush engagement with the lower portion 20 of the dispenser 12. The upper locking tabs 36 engage the lower locking tabs 38 to retain the dispenser 12 in the closed configuration. As illustrated in FIGS. 6 and 7, the package 14 contents are readily dispensed by pushing the squeegee 28 in its track 40 portion along the package 14. The V-shaped plow 46 ensures complete emptying of the package 14 contents.

The invention enables convenient use and precise application of extremely versatile adhesives. The refill packages are inexpensively manufactured and convenient to use. The volume of waste products are substantially reduced in comparison with prior art systems. Further, no uncured chemicals remain in the used package to pose an environmental hazard after disposal.

It will be appreciated by those skilled in the art that the materials used in the construction of the dispenser and the package, and the dimensions used in the various components, will be selected for the particular anticipated use. Although a specific configuration for dispenser and package has been illustrated and described, those skilled in the art will appreciate that alternative configurations can be utilized.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A dispenser for dispensing an adhesive from a flexible package containing the adhesive, comprising;

a lower portion coupled to an upper portion;

said lower portion and said upper portion defining a cavity substantially therebetween;

said cavity being dimensioned to receive substantially therein said package containing the adhesive;

said cavity extending to an exterior portion of said dispenser and defining a nozzle for the adhesive:

said package comprising a first compartment containing the first part of the adhesive, a second compartment containing the second part of the adhesive, and a frangible seal between said first compartment and said second compartment for separating the first and second parts of the adhesive when said frangible seal is intact and for allowing the first and second adhesive parts to be combined for use when said frangible seal is broken, said package having a nozzle portion extending through an exterior portion of said dispenser, and further including perforations at said nozzle portion of said package to allow the package to be easily opened to yield a predetermined nozzle contour substantially corresponding to said portion of said dispenser through which said nozzle portion extends; and said upper portion coupled to a squeegee capable of moving the adhesive in said package toward said nozzle, wherein said squeegee is supported by a V-shaped plow coupled to tabs that are capable of slideably engaging said package.

2. A package for adhesives having first and second parts, said package comprising:

a first compartment containing the first part of the adhesive;

a second compartment containing the second part of the adhesive;

a frangible seal between said first compartment and said second compartment for separating the first and second parts of the adhesive when said frangible seal is intact and firm allowing the first and second parts of the adhesive to be combined for use when said frangible seal is broken;

said package including a retaining slot for engaging a retaining means of a dispenser for the adhesives; and said package having a nozzle portion distal said retaining slot, said nozzle portion extending through an exterior portion of the dispenser, and further including perforations at said nozzle portion of said package to allow said package to be easily opened to yield a predetermined nozzle contour substantially corresponding to said portion of the dispenser through which said nozzle portion extends.

3. The package for adhesives as defined in claim 2, further including two retaining apertures disposed adjacent said nozzle portion for engaging retaining posts coupled to the disposer.

* * * * *

UNITED STATES PATENT AND TRADEMARK OFFICE

CERTIFICATE OF CORRECTION

PATENT NO. : 5,425,475

DATED : June 20, 1995

INVENTOR(S) : Clark, Bryan J.

It is certified that error appears in the above-identified patent and that said Letters Patent is hereby corrected as shown below:

Col. 1, Line 12, cancel "pans" and insert --parts--;
Col. 1, Line 19, cancel "pan" and insert --part--;
Col. 3, Line 52, cancel "," in the second occurrence;
Col. 4, Line 35, cancel ".";
Col. 4, Line 62, cancel "rail" and insert --mil--;
Col. 4, Line 65, cancel "C dwell)" and insert --("dwell")--;
Col. 6, line 17, cancel ":" and insert --;--;
Col. 6, Line 65, cancel "disposer" and insert --dispenser--.

Signed and Sealed this

Seventeenth Day of October, 1995

*Attest:*

Bruce Lehman

BRUCE LEHMAN

*Attesting Officer*

*Commissioner of Patents and Trademarks*